US008421779B2

(12) United States Patent
Fan et al.

(10) Patent No.: US 8,421,779 B2
(45) Date of Patent: Apr. 16, 2013

(54) DISPLAY AND METHOD THEREOF FOR SIGNAL TRANSMISSION

(75) Inventors: Wen-Teng Fan, Tainan County (TW); Chien-Ru Chen, Tainan County (TW)

(73) Assignee: Himax Technologies Limited, Tainan (TW)

( * ) Notice: Subject to any disclaimer, the term of this patent is extended or adjusted under 35 U.S.C. 154(b) by 1002 days.

(21) Appl. No.: 12/129,254

(22) Filed: May 29, 2008

(65) Prior Publication Data

US 2009/0295762 A1 Dec. 3, 2009

(51) Int. Cl.
*G09G 5/00* (2006.01)

(52) U.S. Cl.
USPC ..... 345/204; 345/212; 345/89; 345/98; 345/696; 345/214; 345/87; 345/100; 345/99; 345/690

(58) Field of Classification Search ..... 345/204, 345/96, 99, 208, 89, 690, 98, 100
See application file for complete search history.

(56) References Cited

U.S. PATENT DOCUMENTS

| | | | | |
|---|---|---|---|---|
| 7,259,739 | B2 * | 8/2007 | Yun et al. | 345/93 |
| 7,705,841 | B2 * | 4/2010 | Lin | 345/208 |
| 2005/0168428 | A1 * | 8/2005 | Nakajima et al. | 345/99 |
| 2005/0264546 | A1 * | 12/2005 | Chou et al. | 345/204 |
| 2006/0262065 | A1 * | 11/2006 | Luo et al. | 345/98 |
| 2008/0143665 | A1 * | 6/2008 | Nishimura | 345/96 |
| 2009/0128475 | A1 * | 5/2009 | Chang | 345/98 |
| 2009/0295762 | A1 * | 12/2009 | Fan et al. | 345/204 |

FOREIGN PATENT DOCUMENTS

| | | |
|---|---|---|
| TW | 200641749 | 12/2006 |
| TW | 200705373 | 2/2007 |
| TW | I277793 | 4/2007 |
| TW | I285998 | 8/2007 |

OTHER PUBLICATIONS

"Office Action of Taiwan counterpart application" issued on Oct. 24, 2012, p1-p12, in which the listed references were cited.

* cited by examiner

*Primary Examiner* — Alexander S Beck
*Assistant Examiner* — Amen Bogale
(74) *Attorney, Agent, or Firm* — J.C. Patents

(57) ABSTRACT

A display and a method for signal transmission of the display are provided. The display has a source driver, a panel, and a timing controller having at least one data pin and a clock signal pin. The timing controller sends a clock signal to the source driver via the clock signal pin, and then sends a start pulse pattern to the source driver via the at least one data pin such that the source driver is notified to receive setting signals and display data signals. The source driver drives the panel according to the setting signals and the display data signals received from the timing controller via the at least one data pin. One or more of the setting signals are received by the source driver within every clock of the clock signal.

12 Claims, 2 Drawing Sheets

DISPLAY AND METHOD THEREOF FOR SIGNAL TRANSMISSION

BACKGROUND OF THE INVENTION

1. Field of Invention

The present invention relates to a display, and more particularly, to a display and a method for signal transmission of the display.

2. Description of Related Art

Various electronic devices, e.g. TVs, laptop computers, monitors and mobile communication terminals, have display devices. The display devices are requested to be thin and light in order to save the volume, weight, and the cost of the electronic devices. To satisfy these requirements, various Flat Panel Displays (FPDs) have been developed as alternatives to more conventional cathode ray tube displays.

A Liquid Crystal Display (LCD) is one kind of Flat Panel Display. Generally, an LCD device includes a timing controller, a source driver, a gate driver, and a panel. Image data received from an external host system, for example, are input to the LCD device. The timing controller of the LCD device converts the format of the inputted image data and generates control signals to control the source driver and the gate driver of the LCD device. The gate driver receives the control signals from the timing controller and applies gate signals to the gate lines of the panel to sequentially drive the gate lines. Relatively, the source driver applies analog driving voltages to the data lines of the LCD panel according to the control signals and data received from the timing controller. By applying voltages to a common electrode and pixel electrodes of the panel, the transparency of the liquid crystal in the corresponding pixels is changed under control such that an image can be displayed on the panel.

FIG. 1 shows a simplified block diagram of a conventional LCD. In order to transmit signals from the timing controller 110 to the source driver 120, a plurality of pins are required. For example, the timing controller 110 uses a plurality of I/O pins to transmit setting signals, such as TP1 (synchronous signal), CLK (clock signal), STH (start pulse pattern), POL (polarity signal), DIR (shift direction control signal), MODE1 (mode control signal), MODE2 (mode control signal), FME (frame signal input signal), LP (power mode signal), RS (driving setting signal), VA (slew rate enhancement signal), VB (slew rate enhancement signal), and DD (display data signal), to the source driver 120.

The display data signal DD contains information for displaying images, and the source drive 120 transforms the display data signal DD into analog driving voltages to drive the LCD panel 130 to display images.

As shown in FIG. 1, too many pins are occupied between the timing controller 110 and the source driver 120 such that signal pads for connecting the I/O pins can not be reduced. Consequently, the source driver 120 has a large circuit area, and the routing area of a PCB of the LCD for accommodating the wires between the timing controller 110 and the source driver 120 is increased.

SUMMARY OF THE INVENTION

The present invention provides a signal transmission method and a driving method for an electronic display apparatus to reduce pin quantity of a source driver.

The present invention provides a signal transmission method and a driving method for transferring setting signals and display data signals via the same pins so as to reduce the number of pads and the PCB routing area of the source driver.

Accordingly, an object of the present invention is to provide a display. The display comprises a timing controller, a source driver, and a panel. The timing controller has at least one data pin and a clock signal pin. The source driver is connected to the data pin and the clock signal pin of the timing controller, and the panel is connected to the source driver. The timing controller sends a clock signal to the source driver via the clock signal pin, and then sends a start pulse pattern to the source driver via the at least one data pin such that the source driver is notified to receive setting signals and display data signals. The source driver receives the setting signals from the timing controller via the at least one data pin during a setting period after receiving the start pulse pattern so as to adjust setting of the display. Further, the source driver receives the display data signals from the timing controller via the at least one data pin after the setting period.

Another object of the present invention is to provide a signal transmission method for transmitting signals from a signal source to a source driver in an electronic display apparatus. The source driver includes a synchronous signal pin, a clock signal pin and at least one data pin. The signal transmission method includes: (a) transmitting a synchronous signal from the signal source to the source driver via the synchronous signal pin; (b) transmitting a plurality of clock signals from the signal source to the source driver via the clock signal pin; (c) keeping the at least one data pin with logic low; (d) after transmitting a start pulse pattern from the signal source to the source driver via the at least one data pin, transmitting a setting signal from the signal source to the source driver via the at least one data pin during a setting period, wherein the start pulse pattern indicates the source driver to receive a setting signal and a display data signal, the setting signal is used to adjust setting of the electronic display apparatus; and (e) after the setting period, transmitting the display data from the signal source to the source driver via the at least one data pin.

A further object of the present invention is to provide a driving method for an electronic display apparatus. The electronic display apparatus includes at least a timing controller and a source driver, and the source driver includes a synchronous signal pin, a clock signal pin and at least one data pin. The driving method includes: (a) transmitting a synchronous signal from the signal source to the source driver via the synchronous signal pin; (b) transmitting a plurality of clock signals from the signal source to the source driver via the clock signal pin; (c) keeping the at least one data pin low; (d) after transmitting a start pulse pattern from the signal source to the source driver via the at least one data pin, transmitting a setting signal from the signal source to the source driver via the at least one data pin during a setting period, wherein the start pulse pattern indicates the source driver to receive a setting signal and a display data signal, and the setting signal is used to adjust setting of the electronic display apparatus; (e) after the setting period, transmitting a display data from the signal source to the source driver via the at least one data pin; and (f) decoding the received setting signal and the received display data via the source driver to drive the electronic display apparatus.

It is to be understood that both the foregoing general description and the following detailed description are exemplary, and are intended to provide further explanation of the present invention as claimed.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the present invention.

DESCRIPTION OF THE EMBODIMENTS

Figure 1:
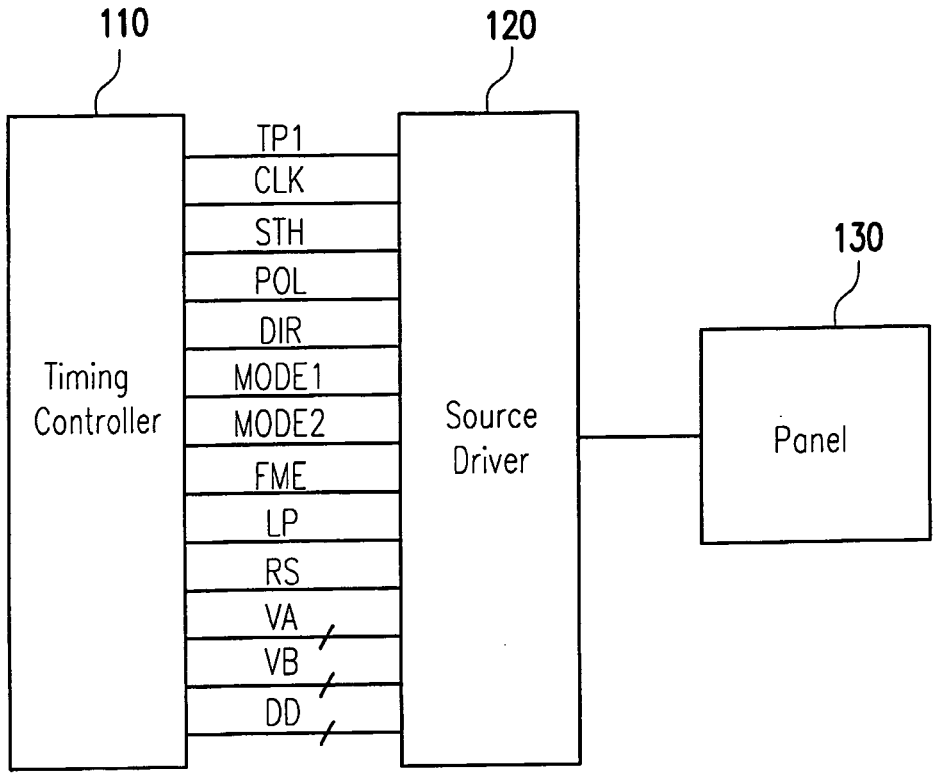
FIG. 1 (PRIOR ART)
FIG. 1 shows a simplified block diagram of a prior TFT-LCD apparatus.

Reference will now be made in detail to the present embodiments of the present invention, examples of which are illustrated in the accompanying drawings. Wherever possible, the same reference numbers are used in the drawings and the description to refer to the same or like parts.

Figure 2:
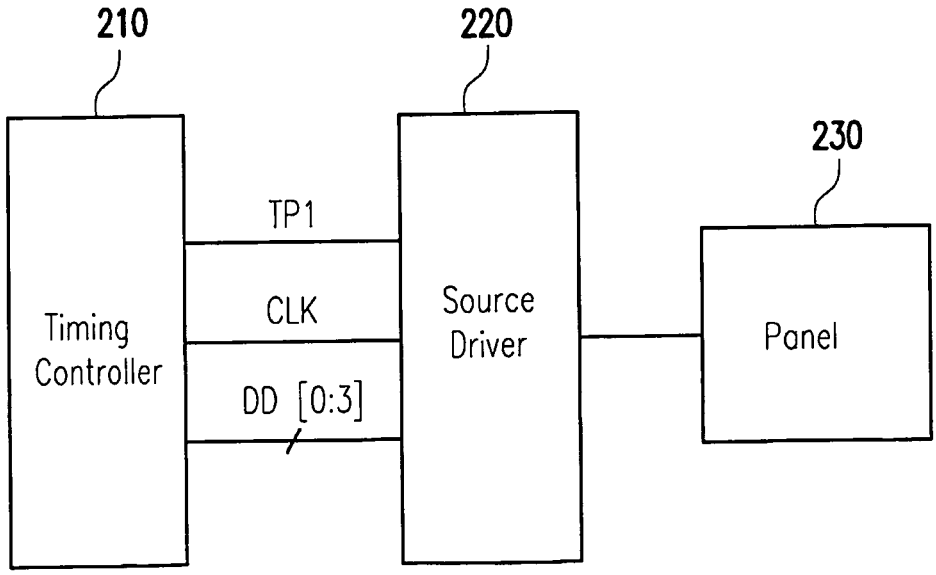
FIG. 2 shows a simplified block diagram of a TFT-LCD apparatus according to an embodiment of the present invention.

FIG. 2 is a simplified block diagram of an electronic display apparatus according to an embodiment of the present invention. In the embodiment, the electronic display apparatus is a TFT-LCD. As shown in FIG. 2, signals are transmitted from a signal source, which is a timing controller 210 in this embodiment, to a source driver 220 via I/O pins TP1, CLK and DD0-DD3. Herein, the I/O pin TP1 is a synchronous signal pin, the I/O pin CLK is a clock signal pin, and each of the I/O pins DD0-DD3 is a data pin. This embodiment is exemplified by utilizing four data pins DD0-DD3, but the present invention is not limited thereto.

Figure 3:
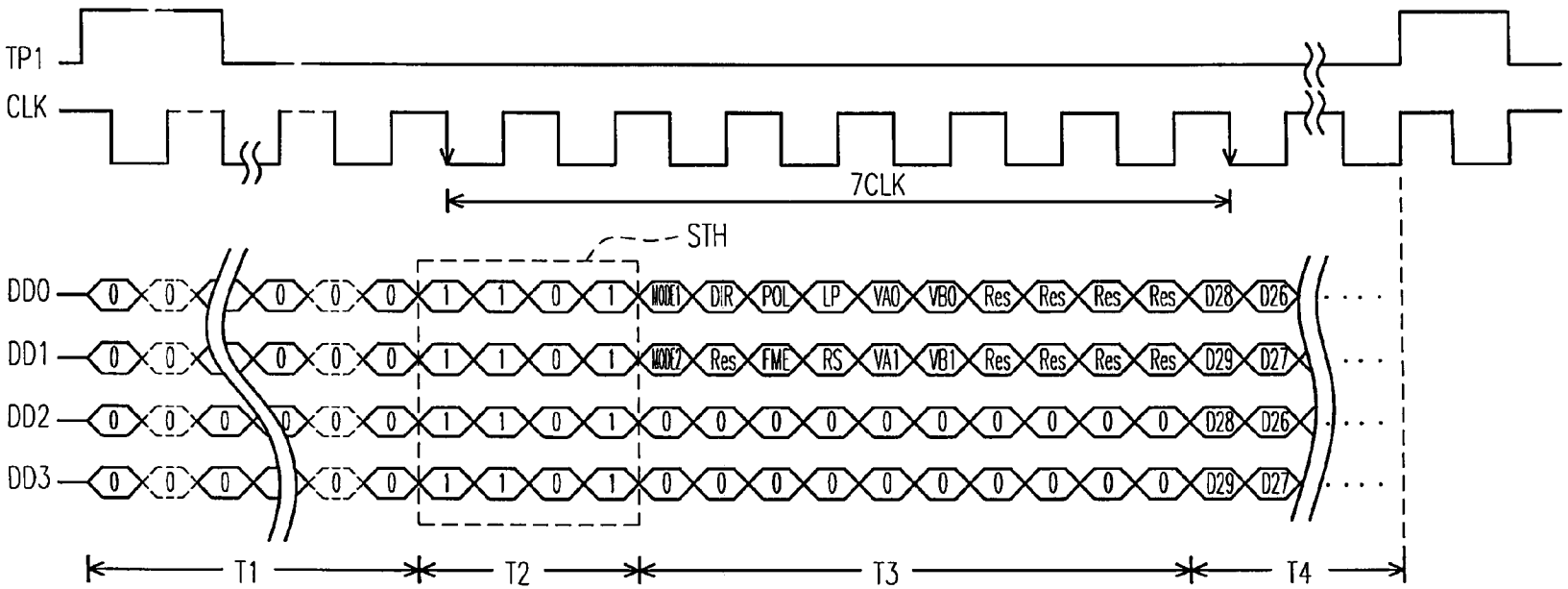
FIG. 3 shows waveforms of signals transmitted via pins TP1, CLK, and DD0-DD3 according to the embodiment of the present invention.

FIG. 3 is a timing diagram showing waveforms of signals transmitted via the pins TP1, CLK, and DD0-DD3 according to the embodiment of the present invention. A plurality of setting signals, which are used to adjust the setting of the electronic display apparatus, are transmitted to the source driver 220 via the pins DD0-DD3.

After outputting a transfer pulse of a synchronous signal TP1, the timing controller 210 sends signals, for driving pixels of the panel 230, to the source driver 220. During the period T1 (shown in FIG. 3), signals transmitted via the pins DD0-DD3 are kept to be 0 (i.e. low) due to the preservation of energy. During the period T2, each of the pins DD0-DD3 transmits a start pulse pattern STH, e.g. a data sequence of "1-1-0-1" in this embodiment, to the source driver 220. The start pulse pattern STH notices the source driver 220 to receive the setting signals and the display data signals for driving the pixels of the panel 230. After outputting the start pulse pattern STH, the timing controller 210 transmits the setting signals to the source driver 220 via the data pins DD0-DD3 within a setting period T3 such that the electronic display apparatus could be set according to the setting signals. It should be noted that it is not necessary to use all of the data pins DD0-DD3 to transmit the start pulse pattern STH. For example, in other embodiments of the present invention, only one or part of the data pins DD0-DD3 is used for the transmission of the start pulse pattern STH.

Within the setting period T3, several setting signals are sent from the timing controller 210 to the source driver 220 via one or more data pins in the embodiment, the setting signals are transmitted to the source driver 220 via the pins DD0-DD1 during the setting period T3. Every clock of the clock signal CLK within the setting period T3, two of the setting signals are transmitted to the source driver 220 by each one of the pins DD0-DD1. The setting signals transmitted via DD0-DD1 during the setting period T3 may include, for example, DIR, POL, LP, RS, FME, MODE1/MODE2, VA0, VA1, VB0, and VB1, which will be explained later. The transmission sequence of the setting signals may be different in other embodiments of the present invention, and the quantity of the setting signals may be changed based on specific design of the source driver and the timing controller. Since two of the setting signals are outputted to the source driver 220 by each one of the pins DD0-DD1 within every clock of the clock signal CLK, the required I/O pins for transmitting the setting signals could be reduced as compared with the prior art.

During the setting period T3, one of the setting signals transmitted by the pin DD0 is "DIR". The setting signal DIR is a shift direction control signal that indicates the shift direction of shift registers positioned in the source driver 220. For example, the setting signal DIR with logic high indicates the shift direction is from left channel to the right channel. On the other hand, the setting signal DIR with logic low indicates the shift direction is from right channel to left channel.

During the setting period T3, one of the signals transmitted by the pin DD0 is "POL". The setting signal POL is a polarity inverting control signal that indicates polarity for the panel 230 of the electronic display apparatus. When the setting signal POL is high, gamma reference voltages Vγ11 to Vγ20 are related to output buffers $OUT_{2n-1}$ (n is a positive integer), and gamma reference voltages Vγ1 to Vγ10 are related to output buffers $OUT_{2n}$. When the setting signal POL is low, the gamma reference voltages Vγ1 to Vγ10 are related to output buffers $OUT_{2n-1}$, and the gamma reference voltages Vγ11 to Vγ20 are related to output buffers $OUT_{2n}$.

During the setting period T3, one of the signals transmitted by the pin DD0 is "LP". The setting signal LP is a low power mode signal that indicates power consumption mode of the source driver 220. When the setting signal LP is low, the source driver 220 operates in a low power mode. When the setting signal LP is high, the source driver 220 operates in a normal power mode.

During the setting period T3, one of the signals transmitted by the pin DD1 is "RS". The setting signal RS is a driving setting signal which indicates the driving ability of the source driver. When the setting signal RS is high, the source driver 220 operates with heavy load. When the setting signal RS is high, the source driver 220 operates with light load.

During the setting period T3, one of the signals transmitted by the pin DD1 is "FME". The setting signal FME is a frame signal input signal which indicates a gate driver start pulse for the electronic display apparatus.

During the setting period T3, one of the signals transmitted by the pin DD0 is "MODE1", and one of the signals transmitted by the pin DD1 is "MODE2". Either the setting signal MODE1 or the setting signal MODE2 is a pixel arrangement mode control signal which indicates a pixel arrangement mode for the panel 230.

During the setting period T3, one of the signals transmitted by the pin DD0 or DD1 is "VA0" or "VA1". Both the setting signals "VA0" and "VA1" are slew rate enhancement signals which indicate the slew rate of corresponding operational amplifiers of the source driver 220. The default value of the setting signal VA1 is low, and the default value of the setting signal VA0 is high. However, when VA1 is low and VA0 is low, the bias current of the operational amplifiers is equal to 100% of a maximum bias current such that the panel 230 operates with the most energy-consumed power. When VA1 is low and VA0 is high, the bias current of the operational amplifiers is equal to 80% of the maximum bias current. When VA1 is high and VA0 is low, the bias current of the operational amplifiers is 67% of the maximum bias current. Further, when VA1 is high and VA0 is low, the bias current of the maximum bias current is 57% of the maximum bias current such that the panel 230 operates with the least energy-consumed power.

During the setting period T3, one of the signals transmitted by the pin DD0 or DD1 is "VB0" or "VB1". Both the setting signals VB0 and VB1 are RSDS (reduced swing differential signaling) bias enhancement signals which indicates the RSDS bias control for the source driver 220. The default value of the setting signal VB1 is low, and the default value of the setting signal VB0 is high. When VB1 is high and VB0 is low, the RSDS bias current is equal to a maximum RSDS bias. When VB1 is low and VB0 is high, the RSDS bias current is equal to 80% of the maximum RSDS bias. When VB1 is high and VB0 is low, the RSDS bias current is equal to 67% of the maximum RSDS bias. When VB1 is high and VB0 is high, the RSDS bias current is equal to 57% of the maximum RSDS bias.

Within the setting period T3, the sub-period with symbols "Res" of the pins DD0 and DD1 could be reserved to send other setting signals if necessary, Similarly, the sub-periods with marks "0" of the pins DD2-DD3 within the setting period T3 could be used to send other setting signals if necessary. During the period of T4, display data signals D26-D29, for determining display values of the pixels of the panel 230, are transmitted by the pins DD0-DD3. Then, when another transfer pulse of the synchronous signal TP1 is received, the source driver 220 drives the panel 230 according to the display data signals received within the period of T4.

Relatively, in another embodiment of the present invention, a method for driving the electronic display apparatus is provided. The driving method includes: (a) transmitting the synchronous signal TP1 from the timing controller 210 to the source driver 220 via the synchronous signal pin during the period T1; (b) transmitting the clock signal CLK from the timing controller 210 to the source driver 220 via the clock signal pin; (c) keeping the data pins with logic low during the period T1 (optional for power saving); (d) sending the start pulse pattern STH, and then sending setting signals, from the timing controller 210 to the source driver 220 via the data pins DD0-DD3 during the period T2; (e) during the setting period T3, sending the display data signals from the timing controller 210 to the source driver 220 via the data pins DD0-DD3; and (f) decoding the received setting signals and the received display data signals to drive the panel 230.

It will be apparent to those skilled in the art that various modifications and variations can be made to the structure of the present invention without departing from the scope or spirit of the present invention. In view of the foregoing descriptions, it is intended that the present invention covers modifications and variations of this invention if they fall within the scope of the following claims and their equivalents.

What is claimed is:

1. A display comprising:

a timing controller having at least one data pin and a clock signal pin and a transfer pulse pin, wherein the transfer pin sends a transfer pulse indicating a first state and a second state;

a source driver connected to the at least one data pin and the clock signal pin and the transfer pulse pin of the timing controller; and a panel connected to the source driver;

wherein the timing controller sends a clock signal to the source driver via the clock signal pin, sends the transfer pulse via the transfer pulse pin, and then after the transfer pulse shifts from the first state to the second state, the timing controller sends a start pulse pattern comprising a predetermined and specific serial bit pattern to the source driver via the at least one data pin such that the source driver receives setting signals and display data signals in response to the predetermined and specific serial bit pattern while the transfer pulse indicates the second state; and wherein the source driver receives the setting signals from the timing controller via the at least one data pin during a setting period after receiving the transfer pulse and then the start pulse pattern so as to adjust setting of the display, and the source driver receives the display data signals from the timing controller via the at least one data pin after the setting period, and the source driver drives the display panel when receiving the next transfer pulse.

2. The display of claim 1, wherein all of the at least one data pin is pulled low as the timing controller starts sending the start pulse pattern.

3. A signal transmission method for transmitting signals from a signal source to a source driver in a display, the source driver including at least one data pin, the method comprising:

transmitting a synchronous signal from the signal source to the source driver and keeping all of the at least one data pin low;

transmitting a clock signal from the signal source to the source driver via a clock signal pin;

transmitting a start pulse pattern comprising a predetermined and specific serial bit pattern from the signal source to the source driver via at least one data pin after the synchronous signal shifts from a first state to a second state, wherein the start pulse pattern notifies the source driver to receive setting signals and a display data signal by using the predetermined and specific bit pattern;

transmitting the setting signals from the signal source to the source driver via the at least one data pin during a setting period while the synchronous signal is in the second state, wherein the setting signals are used to adjust setting of the display; and after the setting period, transmitting the display data signal from the signal source to the source driver via the at least one data pin while the synchronous signal is in the second state, and then the source driver drives the display when receiving the next synchronous pulse.

4. The signal transmission method of claim 3, wherein the setting signals include a shift direction control signal, which indicates shift direction of shift registers of the source driver.

5. The signal transmission method of claim 3, wherein the setting signals include a polarity inverting control signal, which indicates polarity for a display panel of the electronic display apparatus.

6. The signal transmission method of claim 3, wherein the setting signals include a power mode signal, which indicates power consumption mode of the source driver.

7. The signal transmission method of claim 3, wherein the setting signals include a driving setting signal, which indicates driving ability of the source driver.

8. The signal transmission method of claim 3, wherein the setting signals include a frame signal input signal, which indicates a gate driver start pulse for the electronic display apparatus.

9. The signal transmission method of claim 3, wherein the setting signals include a pixel arrangement mode control signal, which indicates a pixel arrangement mode for the display panel of the electronic display apparatus.

10. The signal transmission method of claim 3, wherein the setting signals include a slew rate enhancement signal which indicates slew rate of operational amplifiers of the source driver.

11. The signal transmission method of claim 3, wherein the setting signals include a RSDS bias enhancement signal which indicates RSDS bias control for the source driver.

12. A driving method for a source driver in a display, the display further including a panel and a timing controller having a transfer pulse pin and a clock signal pin and at least one data pin, the method comprising:

receiving a clock signal from the timing controller via the clock signal pin;

receiving a transfer pulse which indicates a first state and a second state from the timing controller;

receiving a start pulse pattern comprising a predetermined and specific serial bit pattern from the timing controller via the at least one data pin after the transfer pulse is received by the source driver and shifts from the first state to the second state;

receiving a plurality of setting signals while the transfer pulse is in the second state from the timing controller to the source driver via the at least one data pin during a setting period which is after receiving the start pulse pattern so as to adjust setting of the display;

setting the display according to the received setting signals;

receiving a display data signal from the timing controller via the at least one data pin while the synchronous signal is in the second state; and driving the panel according to the display data signal when the source driver receives the next transfer pulse.

* * * * *